United States Patent [19]

Waizer et al.

[11] 4,381,188

[45] Apr. 26, 1983

[54] GRINDING DISK

[75] Inventors: Walter Waizer, Innsbruck; Harald Helletsberger, Wattens; Christof Kriegshaber, Schwaz; Volker Selgrad, Innsbruck, all of Austria

[73] Assignee: Tyrolit-Schleifmittelwerke Swarovski KG, Schwaz, Austria

[21] Appl. No.: 229,671

[22] Filed: Jan. 29, 1981

[30] Foreign Application Priority Data

Apr. 1, 1980 [AT] Austria ..... 1753/80

[51] Int. Cl.[3] ..... B24D 3/04; B24D 3/28

[52] U.S. Cl. ..... 51/298; 51/307; 51/308; 51/309

[58] Field of Search ..... 51/307, 298, 308, 309

[56] References Cited

U.S. PATENT DOCUMENTS

| | | | |
|---|---|---|---|
| 2,729,553 | 1/1956 | Price | 51/307 |
| 2,877,103 | 3/1959 | Lane | 51/298 |
| 3,592,618 | 7/1971 | Alden | 51/298 |
| 3,868,232 | 2/1975 | Sioui | 51/298 |
| 4,021,208 | 5/1977 | Oberbichler | 51/298 |

FOREIGN PATENT DOCUMENTS

| | | | |
|---|---|---|---|
| 483777 | 4/1938 | United Kingdom | 51/298 |

*Primary Examiner*—James H. Derrington

*Attorney, Agent, or Firm*—Wenderoth, Lind & Ponack

[57] ABSTRACT

An abrasive disk comprising abrasive grains such as corundum, a bonding material, for example a resin, and a filler material. At least part of the filler material is active in the grinding process.

Particles of this filler material are provided in the disk in the form of pellets or granules. The pellets and granules preferably consist of more than one substance. One substance forms a matrix and at least one other substance is imbedded in said matrix.

23 Claims, 2 Drawing Figures

Fig. 1
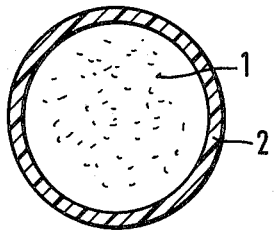
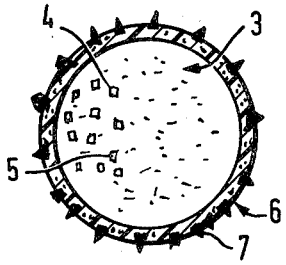
Fig. 2

GRINDING DISK

BACKGROUND OF THE INVENTION

1. Field of the Invention

The present invention relates to an abrasive article comprising abrasive grains, e.g. corundum, an organic bonding agent, e.g. phenolic resin, or an inorganic, coldsetting bonding agent, e.g. phosphate bond, and an active filler.

2. Description of the Prior Art

It is already known that fillers are used in abrasive articles. In the abrasive industry, the term filler applies to the three following groups:

1. Fillers in the classic, usual sense, used for filling plastics materials.

These fillers have the following effects:

(a) Decreased necessity for resin; consequently lower costs of the resin system and, hence, of the abrasive article.

(b) Reinforcing effects and, consequently, increased stability of the bond between the abrasive grains. This effects an increase in the "bursting speed", abrasive hardness, lateral stability etc. of the abrasive article.

(c) Decrease in the bond stability, in such a way obtaining a smoother abrasion. Blunt abrasive grains break out more easily so that the self-sharpening properties of the abrasive articles are improved, however, the wear of the abrasive disks is increased.

With some fillers two effects, (a) and (b), or (a) and (c), occur at the same time.

Examples of such fillers which have been used are: wood powder, coconut shell flour, stone dust, feldspar, kaolin, quartz, short glass fibers, asbestos fibers, ballotini, surface-treated fine grain (silicon carbide, corundum etc.), pumice stone, cork powder etc.

It is a common feature of these fillers that they are "inactive", i.e. they do not undergo any chemical reaction or physical change during the abrasive process and therefore do not create any positive effect on the grinding process.

2. Fillers influencing the making of the grinding disks, particularly the thermal curing of the synthetic resins, are e.g. magnesium oxide, and calcium oxide.

3. "Active fillers". They undergo chemical reaction or physical change during the abrasive operation, which have a positive influence on the behaviour of the abrasive. These fillers should particularly cause an increase in the service-life of the abrasive tool and a decrease in the heating of the workpiece and the abrasive article and, hence, avoid thermal destruction. These fillers are the prerequiste for an economic processing, when materials that are hard to chip, such as unalloyed low carbon steels or titanium, are to be worked.

Active fillers can also obviously produce the same effects as the fillers indicated under (1) and (2) (increase or decrease in stability, influence on the curing process, etc).

In addition to the fillers, additives improving the adhesiveness between the abrasive grain and the bonding agent (e.g. coatings with silanes, or e.g. frits with fused metal oxides, ceramic coatings, etc.) may also be employed.

Other additives facilitate processing, for example, by either improving the noncaking free flowing qualities of the abrasive mix or reducing the internal friction in the pressing process. It is not necessary that these additives are active in the actual abrasive process.

The active fillers are the most important fillers in mixes for abrasive disks. Their effects can generally be divided into the three following main groups:

1. Decrease in the friction between abrasive grain and the workpiece, and between the abrasive grain and chips, i.e. the fillers and their by-products, must have the effect of high temperature lubricants or high pressure lubricants. They can thereby form a film of melted mass (e.g. cryolite) or a solid lubricating film (graphite, molybdenum sulfide).

2. Protective effect by forming a surface film on the abrasive grain, workpiece and chips. Grain destruction due to diffusion processes (e.g. spinel formation when grinding iron material containing corundum), the welding of the grit to the grain or to the workpiece, and the formation of built-up edges (covering of the grain with grit) are avoided.

3. Cooling effect in a location between the chips and abrasive grain, due to high melting or vaporization heat in an advantageous temperature range. That is, an endothermic reaction of the filler material takes place.

Particularly active fillers are, for example, halogenides (e.g. lead chloride, fluorspar, cryolite etc.), chalogenides (e.g. pyrite, antimony sulfide, zinc sulfide, molybdenum sulfide, selenides, tellurides etc.), low melting metals (e.g. lead, tin, low melting composition metals,) high pressure lubricants (e.g. graphite). In practice, lead chloride and antimony trisulfide have proved to be the best fillers in respect of service life and low temperature ("cool" abrasion).

It has been found that a filler is the more active the lower its phase change temperature (melting-, boiling-, sublimation-, decomposition point) is. Due to the processing conditions in the manufacture of abrasive articles, these temperatures cannot fall below a certain value. Moreover, chemically highly active elements or compounds, e.g. chlorine, hydrogen chloride, sulfur, sulfur dioxide etc., should be set free in the grinding process during decomposition.

Numerous substances can, however, not or only under certain circumstances be employed in practice as they are expensive (noble metal halogenides, molybdenum sulfide), toxic (arsenic-, selenium-, lead compounds) or hygroscopic and of high water solubility (numerous chlorides). They further strongly react with the uncured phenolic resin system (hygroscopic chlorides) or reduce the disk stability (e.g. graphite sulfur).

Some of these materials, e.g. metal chlorides, such as ferric chloride ($FeCl_3$), zinc chloride, tin chloride, and potassium chloride, as well as elemental sulfur, are highly active and can favourably be employed in view of their low toxicity (high TLV) and costs. (TLV = treshold limit values).

Graphite is a well known high temperature- and high pressure lubricant, but it creates a number of adverse effects in abrasive articles. Pulverized graphite alone or in connection with usual, active fillers effects only a slight improvement of the abrasive properties. It would be advantageous to employ graphite in the form of coarse grains (grain size about the same as the size of the abrasive grain), which would be an advantage in the abrasive process. Adverse effects are created, however, by the high tendency of graphite to convert into dust or powder, when preparing the raw mixtures for the abrasive disks, and by the poor adhesion of the synthetic resins, particularly phenolic resins, to the smooth surfaces of the graphite grains, thus causing a great decrease in the stability of the abrasive article.

SUMMARY OF THE INVENTION

It is, therefore, the object of the present invention to provide an abrasive article of the afore-mentioned kind in which active fillers can be used, which have not, or only to a limited extent, been used in the past because of difficulties arising in the manufacturing process, and in which graphite may occasionally be employed in such a manner that its bond is substantially improved and its active effect is substantially increased by being combined with other matters.

According to the present invention this is achieved by providing the filler or a part of the filler in the form of pellets or granules in the abrasive articles. The filler may, for example, be graphite.

It is preferably provided that the pellets or granules consist of a matrix and substances imbedded therein, said matrix being made of fine grained fillers resistant to water and air and to temperatures up to the manufacturing temperature of the abrasive article, e.g. graphite, pyrite, potassium fluoborate, zinc sulfide, cryolite, calcium fluoride, sodium chiolite ($Na_5Al_3F_{14}$) [$5NaF.3AlF_3$], and of a bonding agent. Said matrix substances are employed alone or as mixtures, and substances selected from the group of active fillers susceptible to water or temperature, e.g. ferric chloride ($FeCl_3$), tin (II) chloride, manganese chloride, are imbedded in said matrix.

Other fillers, such as elemental sulfur, alkaline- and alkaline earth chlorides or halogenides, $AlCl_3$, $CoCl_3$, $CrCl_3$, $FeCl_2$, $NH_4Cl$, may also be employed in the pellets without leaving the scope of the present invention.

It is preferably provided that the average grain size of the matrix substance is substantially finer than the average grain size of the imbedded substances (e.g. graphite 3–20 μm as matrix substance, ferric chloride ($FeCl_3$) 60–150 μm as imbedded substance).

It is further provided that the grain size of the pellets or granules corresponds approximately or is larger than the grain size of the abrasive grains in order to provide sufficient pore space for removing the chips from the abrasive zone at high cutting capacities. The size range of the abrasive grain is 4 mesh to 1200 mesh. The size range of the pellets or granules is 4 mesh to 100 mesh.

By pelletizing or granulating the fillers, fillers which are only marketed in the form of fine grained powders, e.g. cryolite, lead chloride, can be processed to the desired grain size, e.g. similar to the size of the abrasive grain.

Numerous fillers, e.g. graphite or pyrite, have a weak bond in the abrasive disk, when employed in compact, coarse form with smooth surfaces of fracture (smooth faces of cleavage), thereby reducing the stability of the abrasive disk and causing difficulties in the manufacturing process of the abrasive grains due to the bad wettability.

A synthetic resin is preferably used as a bonding agent for the pellets or granules, whereby the resin is, for example, the same as employed in the bond of the abrasive article and has a high affinity to the resin of the bond of the abrasive article.

The composition of the pellets is to be adapted to guarantee sufficient protection of the hygroscopic or otherwise unstable substances. It has proved advantageous to provide the graphite or the stable active fillers in the pellets in an amount of at least 40 percent by volume. The constituent of the highly hygroscopic substances (e.g. ferric chloride) or of the substances which are liquid at the working temperature (e.g. sulfur) should not exceed 30–40 percent by volume preferably, they are present in an amount of 10–40 percent by volume.

It has been further proved that the combination of graphite and filler substances (e.g. calcium hydroxide, aluminium hydroxide), which separate water at relatively low temperatures (up to about 400° C.), create favourable abrasive properties in the manufactured abrasive articles, particularly a cool abrasive behaviour. It has further proved favourable to add small amounts (1 to 10 percent by volume) of Teflon powder or other polymers of high fluorine content and low coefficient of friction to the pellets.

By bonding the pellets or granules with a synthetic resin, which is equal or similar to the bond of the abrasive article, instead of employing graphite grains, a substantially better bond of the pellets or granules is obtained.

The bond as well as the protection of the sensitive fillers in the pellets are substantially improved, when the pellets are provided with a sealing coating. Materials which have proved advantageous for such coatings are synthetic resins which are identical or compatible (gluable) with the disk bond as well as silicates (e.g. cold-hardening systems based on water glass). The adhesion of the disk bond to the coating of the pellets is advantageously improved by adding fine grains (e.g. fine corundum), and to the silicate coating by adding hydrosilicon.

Embodiments of the invention provide that the pellets have a spherical, tetrahedron or other polyhedral form, e.g. rhombic dodecahedron, icosidodecahedron, etc. The pellets should preferably have no sharp edges or points as these are easily rubbed off when preparing the abrasive disk mix.

The pellets can, for example, be made by means of rollers with impressed or recessed portions corresponding to the form and size of the grain, as described in AT-PS No. 354 289. Other methods, e.g. employing granulators, pelletizing plates, spray driers, may also be used.

A preferred embodiment of an abrasive article in accordance with the present invention provides that the diameter or the equivalent spherical diameter of the pellets is almost equal to the average equivalent spherical diameter of the abrasive grains.

The abrasive articles are manufactured in a conventional manner. The abrasive grain and the pellets or granules forming the filler are wetted with a liquid phenolic resol. Then the pulverulent bonding agent of the abrasive article, which is usually a mixture of a Novolak resin and fillers, is added so that the abrasive grain and the filler pellets are coated. Subsequently, the abrasive articles are pressed into forms and cured in furnaces at a temperature of about 180° C.

Other manufacturing methods can obviously also be used, e.g. as employed with hot-pressed, resinoid-bonded abrasive articles.

DESCRIPTION OF THE PREFERRED EMBODIMENTS

EMBODIMENTS

1. Pellets:

1.1 Type 1:

Powdered graphite (grain size approx. 5μ) 50% (by weight)

Ferric chloride (grain size approx. 40μ) 20% (by weight)

Calcium hydroxide (grain size approx. 15μ) 5% (by weight)

Sulfur powder (grain size approx 15μ) 10% (by weight)

Phenolic resin, solution 15% (by weight)

1.2 Type 2:

Pyrite (grain size approx. 50μ) 85% (by weight)

Phenolic resin, solution 15% (by weight)

1.3 Type 3:

Cryolite (grain size approx. 10μ) 65% (by weight)

Zinc chloride (grain size approx. 40μ) 20% (by weight)

Epoxy resin, solution 15% (by weight)

A solution of a Novolak resin-hexa mix in ethanol or of epoxy resin in acetone is used as a bonding agent.

Average pellet size approximately 700 μm. These pellets were coated with the following composition in a fluidized bed dryer.

1.4 Coating:

| | | |
|---|---|---|
| Corundum 600 mesh | 20% | sprayable "laquer" |
| Phenolic resin (dissolved in ethanol) | 80% | |
| Average coating thickness | 40 μm | |
| Curing at a temperature of 135° C. for 5 min. | | |

2. Abrasive article

| | |
|---|---|
| Normal corundum 24 mesh | 73% by weight |
| Phenolic resol (SWC Fl 4) | 4% by weight |
| Novolak B-stage resin (SWC 101) | 8% by weight |
| Coated pellets (Type 1 to 3) | 15% by weight |

SWC stands for Süd-West Chemie, Neu Ulm, Fed. Rep of Germany.

Density of the pressed articles 2.45 gr. per ccm.

Grinding results

Cut off wheels 600 mm in diameter, 7.5 mm thickness, reinforced with fiber glass.

Workpiece material: solid structural steel rod 100 mm in diameter.

Specific cutting rate: 6.5 $cm^2$/sec

Circumferential velocity: 80 m/sec

G-Ratio: [$cm^2/cm^2$]

| | | |
|---|---|---|
| Type 1 | 2.9 | bright cut |
| Type 2 | 2.5 | colored cut |
| Type 3 | 2.6 | bright cut |

The results of types 1 and 2 can be compared to the results of lead-containing severing disks.

The figures of the drawing show schematic sectional views of two embodiments of pellets in accordance with the present invention.

As shown in FIG. 1, the actual pellet body 1 consisting of graphite powder or pyrite or cryolite plus a bonding agent is provided with a coating 2 of phenolic resin.

The embodiment in accordance with FIG. 2 shows a matrix 3 of graphite to which pyrite and a bonding agent may be added.

$FeCl_3$ particles 4 as well as $CaCl_2$ particles 5 are imbedded in said matrix 3.

The pellet is again provided with a coating 6 of phenolic resin, corundum particles 7 having a grain size of 600 mesh, for example, being admixed with said coating 6.

What is claimed is:

1. An abrasive article comprising abrasive grains, a bonding agent and pellets, wherein said pellets comprise (1) a bonding agent, (2) a matrix of at least one stable pulverulent filler resistant to water and air and to temperatures below the abrasive article manufacturing temperature, selected from the group consisting of graphite, pyrite, potassium, fluoborate, zinc sulfide, cryolite, calcium fluoride and sodium chiolite, and (3) at least one active filler imbedded in said matrix, selected from the group consisting of an alkali metal halogenide, an alkaline earth metal halogenide, elemental sulfur, ferric chloride, zinc chloride, tin chloride, manganese chloride, $AlCl_3$, $CoCl_3$, $CrCl_3$, $FeCl_2$ and $NH_4Cl$.

2. An abrasive article according to claim 1, wherein the average grain size of the matrix-forming filler is smaller than the average grain size of the imbedded substance.

3. An abrasive article according to claim 2, wherein ferric chloride of 60–150 μm is imbedded in graphite of 3–20 μm.

4. An abrasive article according to claim 1, wherein the grain size of the pellets corresponds approximately to the grain size of the abrasive grains.

5. An abrasive article according to claim 1, wherein the pellets are spherical.

6. An abrasive article according to claim 1, wherein the pellets have a polyhedral form.

7. An abrasive article according to claim 1, wherein the bonding agent employed for the pellets is a resin identical with the resin of the bond of the abrasive article, or having a high affinity to said resin.

8. An abrasive article according to claim 1, wherein the stable matrix-forming filler is contained in the pellets in an amount of at least 40 percent by volume.

9. An abrasive article according to claim 1, wherein the active filler is contained in the pellets in an amount of between 10 and 40 percent by volume.

10. An abrasive article according to claim 1, wherein polytetrafluoroethylene powder is added to the pellets in an amount of between 1 and 10 percent by volume.

11. An abrasive article according to claim 1, wherein the pellets are provided with a sealing coating.

12. An abrasive article according to claim 11, wherein said sealing coating is a cured synthetic resin or an intermediate condensation resin product compatible with the bonding agent of the abrasive article.

13. An abrasive article according to claim 11, wherein the pellets are provided with an inorganic coating.

14. An abrasive article according to claim 13, wherein the coating is a silicate or a phosphate.

15. An abrasive article according to claim 11, wherein fine grained hard matters are admixed with said coating.

16. An abrasive article according to claim 15, wherein the fine grained hard matters are at least one of silicon carbide, corundum and a silicate.

17. An abrasive article according to claim 1, wherein the stble filler is graphite.

18. An abrasive article according to claim 1, wherein the bonding agent for the pellets is an inorganic binder.

19. An abrasive article according to claim 18, wherein the inorganic binder is based on a silicate or a phosphate.

20. An abrasive article according to claim 1, wherein said bonding agent for the abrasive article is a thermosetting synthetic resin or a coldsetting bonding agent.

21. An abrasive article according to claim 20, wherein said bonding agent is a phenolic resin, a phosphate or a silicate.

22. An abrasive article according to claim 1, wherein the stable filler is graphite, and the graphite is combined in the pellets with a filler separating water at a temperature up to the 400° C.

23. An abrasive article according to claim 22, wherein the filler combined with graphite is calcium hydroxide or aluminium hydroxide.

* * * * *